United States Patent [19]

Trosper et al.

[11] 4,152,755

[45] May 1, 1979

[54] PORTABLE MAGNETICALLY ACTUATABLE FLASHLIGHT

[76] Inventors: Raymond Trosper, 2137 W. Olive; Richard E. Nixt, 1130 W. Ash, both of Fullerton, Calif. 92633; Robert J. Winkler, 2101 E. 4th St. #150, Santa Ana, Calif. 92704

[21] Appl. No.: 807,908

[22] Filed: Jun. 20, 1977

[51] Int. Cl.[2] ..... F21L 7/00

[52] U.S. Cl. ..... 362/158; 362/205; 362/208

[58] Field of Search ..... 335/205; 200/60, 67 F; 362/158, 202, 205, 208

[56] References Cited

U.S. PATENT DOCUMENTS

| | | | |
|---|---|---|---|
| 3,162,376 | 12/1964 | Furuya | 362/158 |
| 3,219,811 | 11/1965 | Young | 362/158 |
| 3,760,312 | 9/1973 | Schlesinger | 335/205 |
| 3,790,912 | 2/1974 | Murphy | 362/205 |
| 3,924,117 | 12/1975 | Brindley | 362/205 |

*Primary Examiner*—Benjamin R. Padgett
*Assistant Examiner*—J. L. Barr
*Attorney, Agent, or Firm*—William C. Babcock

[57] ABSTRACT

A portable magnetically actuatable flashlight that includes a hermetically sealed housing that has the light transmitting lens formed as an integral part thereof, and the housing capable of having an electric circuit defining cartridge on which the battery, light emitting bulb, light reflector, and electric circuit completing switch are mounted to be inserted into or removed from the housing. The electric switch is of the reed type, and is actuated to assume a closed position when a movable permanent magnet disposed exteriorly of the housing is moved to a first position for the magnetic field of the magnet to temporarily dispose the switch in an electric circuit completing position.

5 Claims, 6 Drawing Figures

FIG. 1
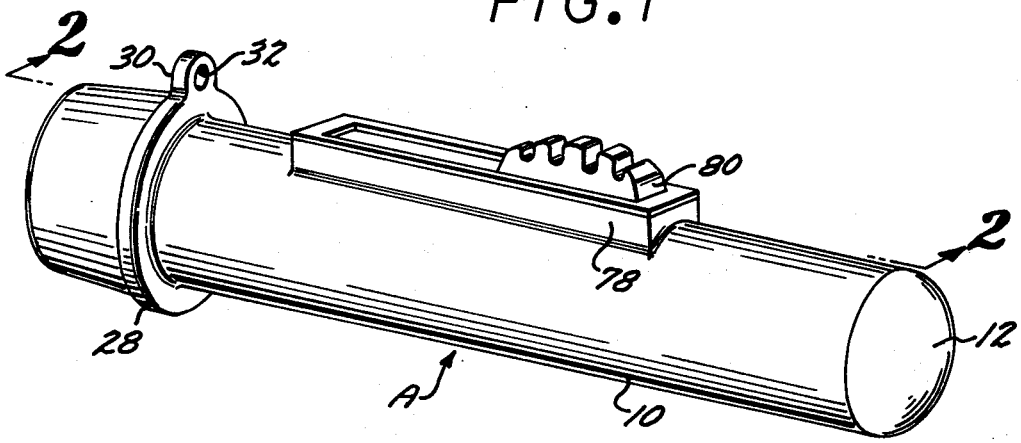
FIG. 2
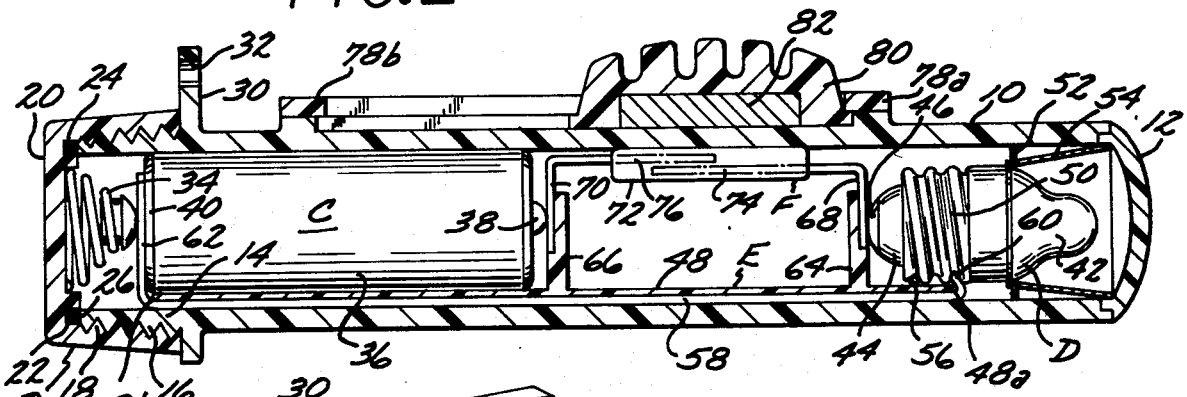
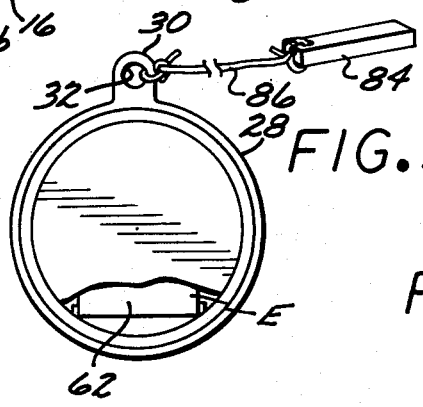
FIG. 3
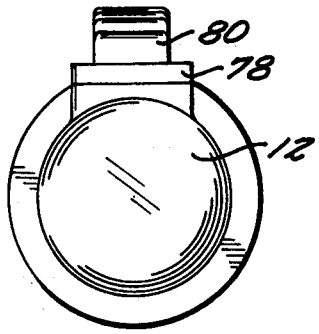
FIG. 4
FIG. 5
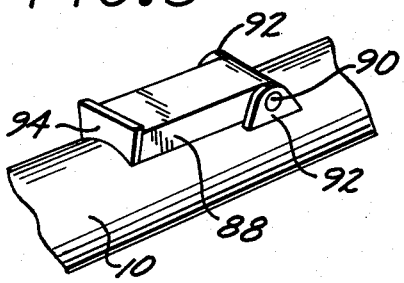
FIG. 6
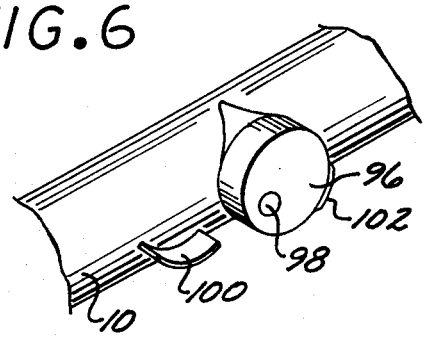

PORTABLE MAGNETICALLY ACTUATABLE FLASHLIGHT

BACKGROUND OF THE INVENTION

1. Field of the Invention

Portable Magnetically Actuatable Flashlight. 2. Description of the Prior Art

Portable flashlights in the past have in the main included a cylindrical housing that on a first end removably support a light transmitting lens and on a second end a threaded cap that includes a compressed electrical conducting spring that pressure contacts one terminal of the battery. The circuit in prior art flashlights is completed either by a slide type switch or a spring loaded button type switch, both of which switches have components exteriorly and interiorly disposed relative to the housing. The slide type switch has the operational disadvantage that it may inadvertently be left in a circuit completing position, and the battery runs down as a result thereof. Prior art flashlights have the operational disadvantage that when left in a damp environment or used in the rain, that moisture will enter the interior of the housing through the threaded connections on the first and second ends of the housing, as well as through the switch mechanism. Moisture that so enters the interior of the housing tends to corrode the contacts of the electric switch by forming a poor electrical conducting film thereon that has a high electrical resistance, as well as reacting with components of the battery to result in the battery swelling radially. A battery may swell radially to the extent that it is extremely difficult if not impossible to slide the same from the housing.

A major object of the present invention is to provide a flashlight that substantially eliminates the operational disadvantages of prior art flashlights.

Another object of the invention is to provide a flashlight that has a hermetically sealed interior confined space to prevent the entry of moisture thereinto, and one that can only be actuated by a permanent magnet being temporarily disposed in a first position adjacent the exterior of the housing.

These and other operational advantages of the present invention over prior art flashlights will become apparent from the following detailed description of the present invention.

SUMMARY OF THE INVENTION

An elongate cylindrical housing formed from a non-electrical conducting rigid material, which housing has a first end closed by a light transmitting lens that is preferably formed integral with the housing and a second threaded end that is removably engaged by a closure assembly that hermetically seals with the housing.

An elongate cartridge is provided that may be slidably inserted into the housing or removed from the housing when the closure is not in a housing closing position. The cartridge on a first end removably supports an electrically energizable light emitting bulb and on a second end at least one battery. The cartridge includes an electrically powered circuit, which circuit has a magnetically actuatable reed type switch intermediately disposed between the bulb and battery. The switch is normally open, and is closed to complete the electric circuit between the bulb and battery only when a permanent magnet exteriorly disposed to the housing is moved to a first position relative to the latter. When the closure is removed from the housing the cartridge may be slid as a unit from the latter to permit replacing of either a battery or light emitting bulb.

BRIEF DESCRIPTION OF THE DRAWING

FIG. 1 is a perspective view of a first form of the invention that has a permanent magnet slidably mounted in a guide on the exterior of the housing, and the magnet capable of being moved longitudinally from a second position to a first position to actuate the reed switch to move to a closed position and complete an electric circuit from the battery to the light emitting bulb;

FIG. 2 is a longitudinal cross-sectional view of the flashlight shown in FIG. 1 and taken on the line 2—2 of FIG. 1;

FIG. 3 is an end elevational view of the flashlight shown in FIG. 1, and with a second permanent magnet tethered to the housing, the second magnet may be used to actuate the reed type switch when moved to a first position relative to the housing;

FIG. 4 is an end elevational view of the housing and that illustrates the light transmitting lens;

FIG. 5 is a perspective view of a portion of the invention and illustrating a first alternate support that permits a permanent magnet to be moved to either a first or second position relative to the housing; and FIG. 6 is a perspective view of a portion of the invention and illustrating a second alternate support that permits a permanent magnet to be moved to either a first or second position relative to the housing.

DESCRIPTION OF THE PREFERRED EMBODIMENT

The portable magnetically actuatable flashlight A as may be seen in FIGS. 1 and 2 includes an elongate cylindrical housing 10 that has a first closed end portion 12 that is a light transmitting lens. Housing 10 has a second end portion 14 on which external threads 16 are defined. The threads 16 are removably engaged by the internal threads 18 formed in a cup-shaped closure B, which closure includes a web 20. The web 20 on the interior surface thereof has a groove 22 formed therein in which a resilient O-ring 24 is disposed. When the closure B is screwed onto threads 16 as shown in FIG. 1 the O-ring 24 is forced into pressure sealing contact with an annulus end surface 26 defined on an end portion 14 as shown in FIG. 2. The housing 10, lens 12 and closure B are preferably molded or otherwise formed from a commercially available polymerized resin.

A stop ring 28 extends outwardly from the second housing end portion 14, and is contacted by the forward extremity of closure B after O-ring 24 effects a seal with end surface 26. The stop ring 28 may have a tab 30 extending outwardly therefrom as shown in FIGS. 1 and 2 in which a transverse opening 32 is defined, the purpose of which will later be explained. A helical spring 34 is secured to the interior surface of web 20 and extends forwardly towards lens 12.

A cylindrical battery C is provided that has a cylindrical shell 36 and first and second end terminals 38 and 40. An incandescent bulb D is also provided that has a glass envelope 42 and a threaded cylindrical base 44 that acts as a first terminal and a second terminal 46 on the base that is electrically insulated from the first terminal.

The cartridge E includes an elongate strip 48 of a non-electrical conducting material that has a first end portion 48*a* and second end portion 48*b*. First end portion 48*a* supports a threaded socket 50 that is removably engaged by threaded base 44. Threaded socket 50 includes a transverse guide ring 52 from which a frustoconical light reflector 54 extends forwardly. Socket 50 is secured to strip 48 by fastening means 56. An electrical conductor 58 has the forward end thereof bonded at 60 to socket 50, with the conductor extending longitudinally under strip 48 to develop into an upwardly projecting extension 62 as shown in FIG. 2 that is in contact with second terminal 40.

Strip 48 has first and second legs 64 and 66 extending upwardly therefrom that support first and second electrical conductors 68 and 70 in pressure contact with the second terminal 46 of bulb D and first terminal 38 of battery C. A reed type switch F is provided that has a hollow body 72 in which first and second elongate, parallel, overlapping electrical conductors 74 and 76 are disposed, with the first conductor being resilient and at all times tending to remain in lateral spaced relationship with the second conductor. The first conductor 74 is magnetically attractable.

An elongate guide 78 extends longitudinally on the exterior surface of housing 10 and movably supports a slide 80 therein, which slide has a permanent magnet 82 disposed within the interior thereof. When slide 80 contacts a first end 78*a* of guide 78 magnet 82 is disposed in a first position where it attracts first conductor 74 into pressure contact with second conductor 76 to complete an electric circuit between battery C and bulb D. Upon slide 80 being moved to contact second end 78*b* of slide 78, permanent magnet 82 is so disposed as to no longer attract first conductor 74, and first conductor 74 separates from second conductor 76 to break the electric circuit between battery C and bulb D. A pair of longitudinally extending guides 84 are provided inside housing 10 to slidably engage cartridge E as shown in FIG. 3 to maintain switch F in radial alignment with guide 78.

Should it be desired, the guide 78 and slide 80 may be eliminated, and switch 72 magnetically actuated by a magnet 84 that is tethered by a cord 86 to opening 32 as shown in FIG. 3. When the magnet 84 is moved to a first position relative to housing 10, the switch 72 is actuated. The first position will be indicated on housing 10 by an insignia (not shown).

In FIG. 5 it will be seen that an elongate permanent magnet 88 may be pivotally supported by a pin 90 that extends between two brackets 92 that project from housing 10. When magnet 88 is pivoted to a first position to frictionally engage a clip 94, the switch F is magnetically actuated to complete an electric circuit between battery C and bulb D. When magnet 88 is pivoted from a first position to a second position out of contact with clip 94, conductor 74 separates from conductor 76 and the electric circuit between battery C and bulb D is broken.

In FIG. 6 a circular permanent magnet 96 is eccentrically and pivotally supported by a pin 98 that extends from housing 10. When magnet 96 is pivoted to a first position where it contacts a stop 100, the switch F is magnetically actuated to complete an electric circuit between battery C and bulb D. The electric circuit is broken when magnet 96 is pivoted to a second position as shown in FIG. 6, at which it rests on a second stop 102.

The use and operation of the invention has been explained previously in detail and need not be repeated.

I claim:

1. A portable flashlight structure that defines a hermetically sealed interior cylindrical space in which at least one cylindrical battery having first and second longitudinally spaced terminals that may be removably disposed remain in a dry condition and not deteriorate due to moisture in the ambient atmosphere and be employed to illuminate a lamp that includes an incadescent bulb that has a glass envelope that projects from a threaded base that includes a terminal, said flashlight structure including:

a. a cylindrical housing assembly formed from a rigid waterproof material that defines an elongate cylindrical shell of greater internal diameter and length than that of said battery, said shell having a first closed transparent end that defines a lens, and a second end portion that has external threads thereon, said second end portion terminating in a ring-shaped end surface, and said shell on the interior thereof defining a pair of parallel laterally spaced guides, and a stop ring that extends outwardly from said shell adjacent said external threads;

b. a cup-shaped closure assembly that has internal threads and that includes a transverse web, a circular groove in said web, a resilient sealing ring in said groove, and a coiled spring projecting forwardly from said web, said stop ring being contacted by said closure to prevent further rotation of the latter after said closure has been screwed onto said external threads to the extent said resilient sealing ring is in hermetically sealing pressure contact with said ring-shaped end surface;

c. a cartridge assembly that may be slidably inserted into or removed from said housing as a unit, said cartridge assembly including:

1. an elongate strip that may be slid longitudinally into or out of said housing when disposed between said pair of guides, said pair of guides preventing said strip rotating relative to said housing, said strip having first and second ends, and first and second longitudinally spaced legs that project outwardly from said strip intermediate said first and second ends thereof, said strip and pair of first and second legs formed from an electrical insulating material;
2. a threaded socket rigidly secured to said first end of said strip, said threaded socket removably engaged by said threaded base of said lamp;
3. a guide ring and light reflector supported from said socket and adjacent said bulb;
4. first and second electrical conductors supported from said first and second legs, said first electrical conductor in contact with said terminal of said lamp and said second electrical conductor in contact with a first terminal of said battery when the latter is disposed in said housing and urged towards said second leg by said spring;
5. a normally open magnetically actuatable reed switch intermediately disposed between said first and second legs and connected to said first and second electrical conductors; and
6. a third electrical conductor that extend longitudinally from said socket to said second terminal of said battery; and d. permanent magnet means exteriorly of said housing that when moved from a first position substantially spaced from said reed surface in which the latter is not actuated to a second position closer said reed switch actuating the latter to assume a closed position to complete an electric circuit from said battery to said lamp through said first, second and third conductors to illuminate said lamp.

2. A flashlight structure as defined in claim 1 in which said permanent magnet means is a bar magnet, and said flashlight structure in addition including:

e. guide means on the exterior of said housing that slidably support said bar magnet and permit the latter to be manually moved between said first and second positions.

3. A flashlight structure as defined in claim 1 in which said permanent magnet means in a permanent magnet body and said flashlight structure in addition including:

e. means for pivotally supporting said permanent magnet body from the exterior of said housing to permit said permanent magnet body to be pivoted to either said first or second position.

4. A flashlight structure as defined in claim 3 that in addition includes:

resilient means that tend to maintain said permanent magnet body in said first position when said resilient means are in contact with said permanent magnet body.

5. A flashlight structure as defined in claim 1 in which said stop ring has a transverse opening therein and said permanent magnet means includes:

e. a pliable elongate member that has first and second end portions, said first end portion extending through said transverse opening and tied to said top ring; and f. a permanent magnet body said permanent magnet body secured to said second end of said pliable elongate member, and said permanent magnet body capable of being manually moved from a first position to said second position.

* * * * *